US007114665B1

(12) United States Patent
Mc Tee

(10) Patent No.: US 7,114,665 B1
(45) Date of Patent: Oct. 3, 2006

(54) SPRINKLER HEAD PROTECTIVE GUARD

(76) Inventor: Ronald H. Mc Tee, 1114 N. 150th West, Harrisville, UT (US) 84404

( * ) Notice: Subject to any disclaimer, the term of this patent is extended or adjusted under 35 U.S.C. 154(b) by 0 days.

(21) Appl. No.: 11/336,233

(22) Filed: Jan. 23, 2006

(51) Int. Cl.
*B05B 15/06* (2006.01)
*B05B 1/28* (2006.01)
*A01G 25/06* (2006.01)
*B05B 15/10* (2006.01)

(52) U.S. Cl. ..... 239/288; 239/288.5; 239/201; 239/600

(58) Field of Classification Search ..... 239/288, 239/288.5, 201, 600, 110, 200, 203–206, 239/288.3, 456, 458
See application file for complete search history.

(56) References Cited

U.S. PATENT DOCUMENTS 3,791,581 A 2/1974 Chow
D243,179 S 1/1977 Jooste et al.
4,145,003 A * 3/1979 Harrison et al. ..... 239/288
4,351,477 A 9/1982 Choi
4,781,327 A 11/1988 Lawson
4,986,474 A 1/1991 Schisler et al.
5,938,121 A * 8/1999 Ferguson et al. ..... 239/203
6,494,386 B1 * 12/2002 Banu ..... 239/288
6,629,648 B1 10/2003 Jones
6,648,241 B1 11/2003 Doshay
6,764,025 B1 * 7/2004 Espina ..... 239/288
2005/0284956 A1 * 12/2005 Mast ..... 239/288

* cited by examiner

*Primary Examiner*—David A. Scherbel
*Assistant Examiner*—Darren Gorman

(57) ABSTRACT

A sprinkler head guard includes an inner casing that has a cylindrical shape, and vertically aligned top and bottom openings. A first coupling is conjoined to the inner casing and has a threaded inner surface. A second coupling has axially offset lower and upper ends having threaded outer surfaces. The upper end is mated with the first coupling. The lower end is mateable to a water supply line. An outer casing is slidably and telescopically engageable with the inner casing, and has a bore that becomes situated about the first coupling. The outer casing has a top lip that is flanged outwardly and includes rectilinear creases formed therein. Each crease defines a line of weakness, allowing a user to snap off a top lip portion. The inner and outer casings are shaped for housing a sprinkler head therein. A mechanism is included for locking the casings together.

15 Claims, 7 Drawing Sheets

(ADJUSTABLE MODEL)

(ADJUSTABLE MODEL)

(ADJUSTABLE MODEL)

(ADJUSTABLE MODEL)

(ADJUSTABLE MODEL)

(ADJUSTABLE MODEL)

(ADJUSTABLE MODEL)

(STANDARD MODEL)

(STANDARD MODEL)

SPRINKLER HEAD PROTECTIVE GUARD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to protective guards and, more particularly, to a sprinkler head protective guard for preventing a lawn mower and the like from damaging an in-ground sprinkler head.

2. Prior Art

There are many applications for pop-up sprinklers wherein the sprinkler is contained within a casing buried in the ground and which pops up to a position above the casing during operation. Typically, the sprinkler casing is buried in the ground so that its top surface is substantially flush with the ground level, and the sprinkler is spring-biased to the inoperative position retracted inside the casing. A cover is typically attached to the sprinkler and overlies the top of the casing when the sprinkler is in the inoperative position. During irrigation, water is supplied to the sprinkler through the bottom of the casing and the sprinkler extends to the operative position by popping up out of the casing to a position above the ground, the sprinkler carrying the cover with it during its movement to the extended, operative position.

Pop-up sprinklers of the general type herein involved are widely used in connection with lawns, golf courses, parks, and other installations where it is undesirable to have a permanently-mounted sprinkler projecting above the ground when not in use. One problem that has long been encountered in the use of such pop-up sprinklers is that of dirt, sand, weeds, grass, and other deleterious particulate matter entering the open top of the sprinkler casing during sprinkler operation and which can cause the sprinkler to jam such that it either does not pop up all the way to the operative position, or does not fully retract into the casing after use. This problem has been particularly noticeable where pop-up sprinklers are used in sandy and gravel-concentrated soils. Another problem associated with pop-up sprinklers is that sometimes they do not retract all the way into their housing, and then become vulnerable to being damaged as a lawn mower or other cutting device passes over the location of the sprinkler head.

Accordingly, a need remains for a sprinkler head protective guard in order to overcome the above-noted shortcomings. The present invention satisfies such a need by providing a sprinkler guard that is convenient to use, easy to install, durable in design, facilitates sprinkler head function, and improves the appearance of one's landscape. The fact that the sprinkler head remains unobstructed advantageously ensures that the waster is effectively and efficiently dispensed. The sprinkler guard also prevents a sprinkler head from being impacted by an object such as a person's foot or a lawnmower blade.

BRIEF SUMMARY OF THE INVENTION

In view of the foregoing background, it is therefore an object of the present invention to provide a sprinkler head protective guard. These and other objects, features, and advantages of the invention are provided by an in-ground sprinkler head protective guard for advantageously and effectively preventing a lawn mower and the like from damaging an in-ground sprinkler head and for further preventing undesirable grass and weeds from growing along the in-ground sprinkler head and obstructing a discharge path of water flowing out from the in-ground sprinkler head.

The in-ground sprinkler head protective guard includes an inner casing that has a hollow cylindrical shape and a smooth outer surface. Such an inner casing further has axially opposed and vertically aligned top and bottom openings in fluid communication with the inner surface.

A tubular and cylindrical first coupling is directly conjoined to the inner casing and is concentrically aligned within the bottom opening. Such a coupling has a threaded inner surface that extends downwardly from the inner casing and terminates at a predetermined location subjacent to a bottom surface of the inner casing.

A second coupling has axially offset lower and upper end portions provided with a threaded outer surface. Such an upper end portion is threadably and directly mated with the first coupling such that the lower end portion becomes registered orthogonal to a vertical plane and protrudes outwardly from the inner casing. The lower end portion is threadably mateable to an external water supply line.

An outer casing has a cylindrical shape and smooth inner surface slidably and telescopically engageable directly with the outer surface of the inner casing. Such an outer casing preferably has a diameter greater than a diameter of the inner casing. Such an outer casing has a centralized axial bore formed therein such that the bore becomes concentrically situated about the first coupling when the outer casing is position about the inner casing. The outer casing further has a top lip monolithically formed therewith that radially protrudes outwardly from the inner surface.

Such a top lip is flanged outwardly and includes a pair of rectilinear creases oppositely formed therein and extending tangential to a perimeter of the outer surface bore. Each crease defines a line of weakness for effectively and advantageously allowing a user to snap off a portion of the top lip when positioning the outer casing adjacent to a flat surface. Each of the inner and outer casings is suitably sized and shaped for housing the in-ground sprinkler head therein. Each of the inner and outer casings is formed from a polymer material and outwardly spaced from the in-ground sprinkler head so that the in-ground sprinkler head can freely rotate during operating conditions.

A mechanism is included for locking the inner and outer casings together such that the outer casing is prohibited from disengaging the lower casing until at least one of the outer and lower casings is rotated approximately one quadrant along a rotational path so that the outer casing can be vertically lifted away from the inner casing. The locking mechanism preferably includes an elongated and vertically oriented track that has a longitudinal length equal to a longitudinal length of the inner casing. Such a track has a plurality of vertically spaced L-shaped fingers formed therein that are linearly displaced along the longitudinal axis of the inner casing.

A plurality of equidistantly spaced notches are formed within the inner casing outer surface for slidably and simultaneously receiving the L-shaped fingers therein when the inner and outer casings are rotated about the longitudinal axis and vertically aligned. A plurality of grooves are formed within a top edge of the outer casing. Such grooves are removably interlocked with selected ones of the L-shaped fingers when the outer casing is positioned over and down the inner casing outer surface.

In an alternate embodiment, the locking mechanism may include a plurality of slots formed within a bottom region of the inner casing. An inwardly protruding flange is monolithically formed at a bottom edge of the outer casing. Such a flange is nested within the slots when the outer casing is positioned over and down the inner casing outer surface.

In another embodiment, the outer casing preferably includes a plurality of vertically oriented slots formed therein that are equidistantly spaced apart about a periphery of the outer casing respectively. Such slots are contiguously situated adjacent to a bottom surface of the outer casing such that undesirable debris and fluids can advantageously and effectively properly drain away from the outer casing during inclement weather conditions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
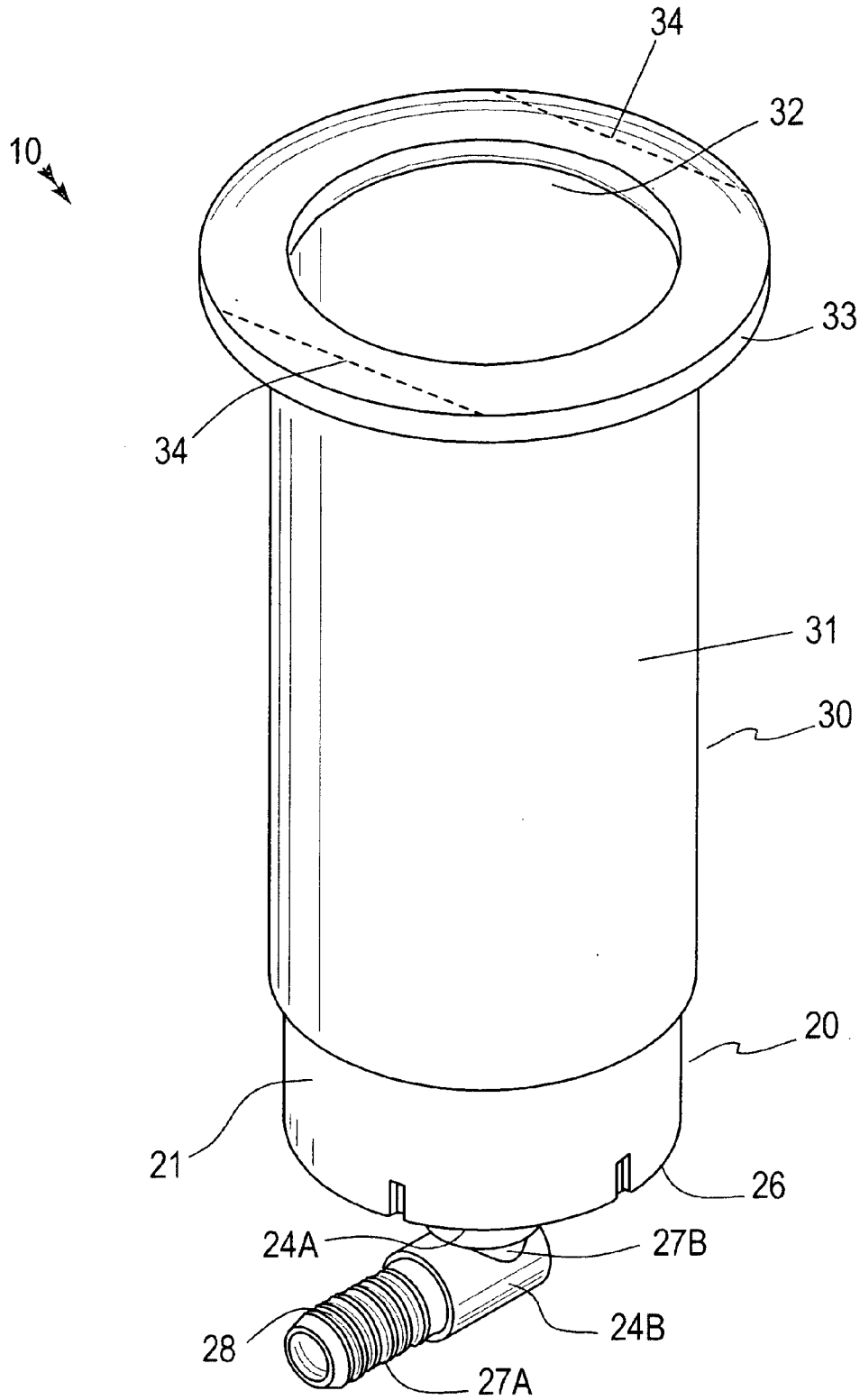
FIG. 1 is a perspective view showing a sprinkler head protective guard, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime, double prime and triple prime numbers refer to alternate embodiments of such elements.

The assembly of this invention is referred to generally in FIGS. 1–8 by the reference numeral 10 and is intended to provide a sprinkler head protective guard. It should be understood that the assembly 10 may be used to protect many different types of sprinkler heads and should not be limited in use to only one specific style of sprinkler heads.

Referring initially to FIGS. 1, 2, 3 and 5, the assembly 10 includes an inner casing 20 that has a hollow cylindrical shape and a smooth outer surface 21. Such an inner casing 20 further has axially opposed and vertically aligned top 22A and bottom 22B openings in fluid communication with the inner surface 23 of the inner casing 20. A tubular and cylindrical first coupling 24A is directly conjoined, without the use of intervening elements, to the inner casing 20 and is concentrically aligned within the bottom opening 22B. Such a coupling 24A has a threaded inner surface 25 that extends downwardly from the inner casing 20 and terminates at a predetermined location subjacent to a bottom surface 26 of the inner casing 20.

Figure 2:
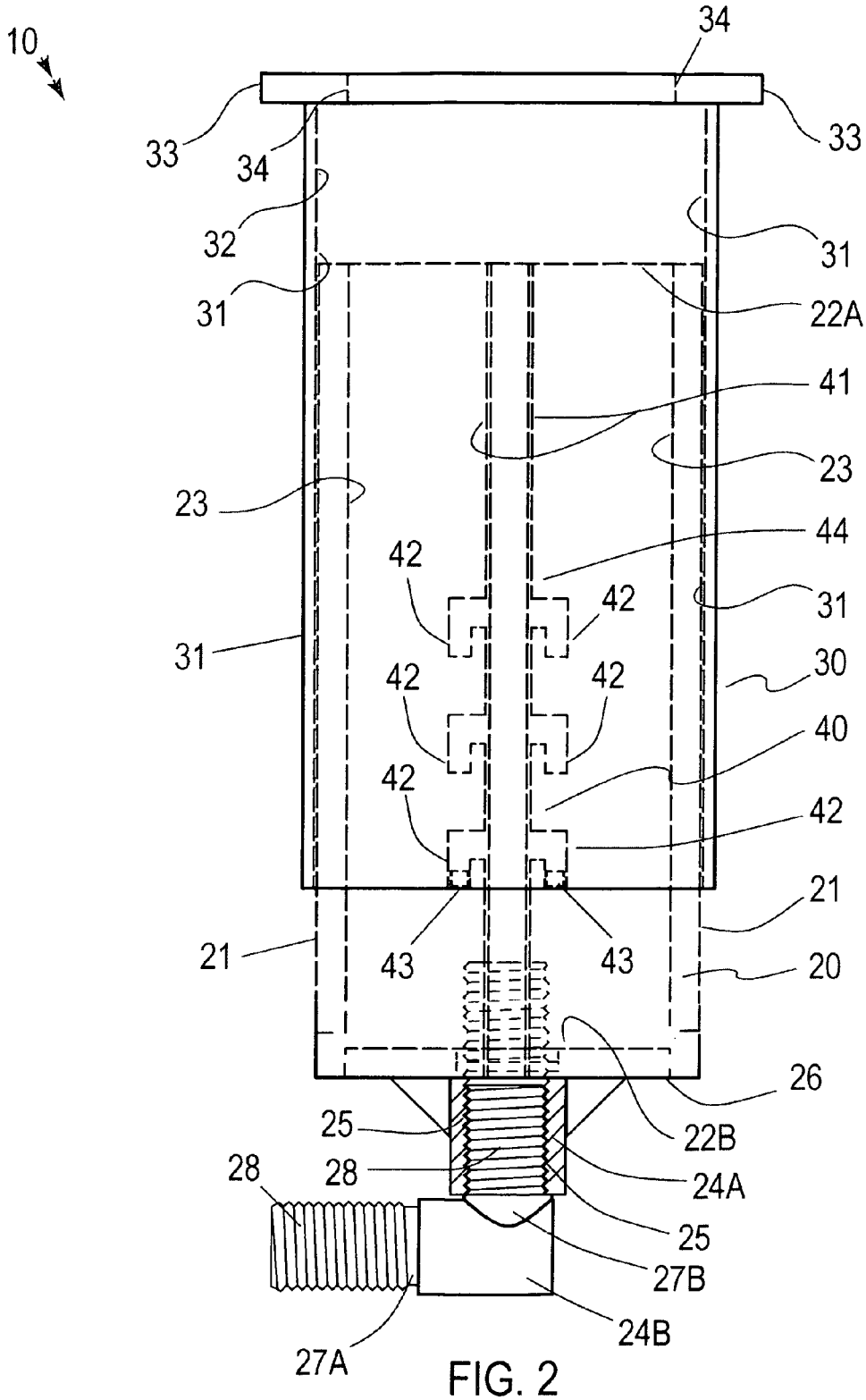
FIG. 2 is a side-elevational view of the assembly shown in FIG. 1.
Figure 3:
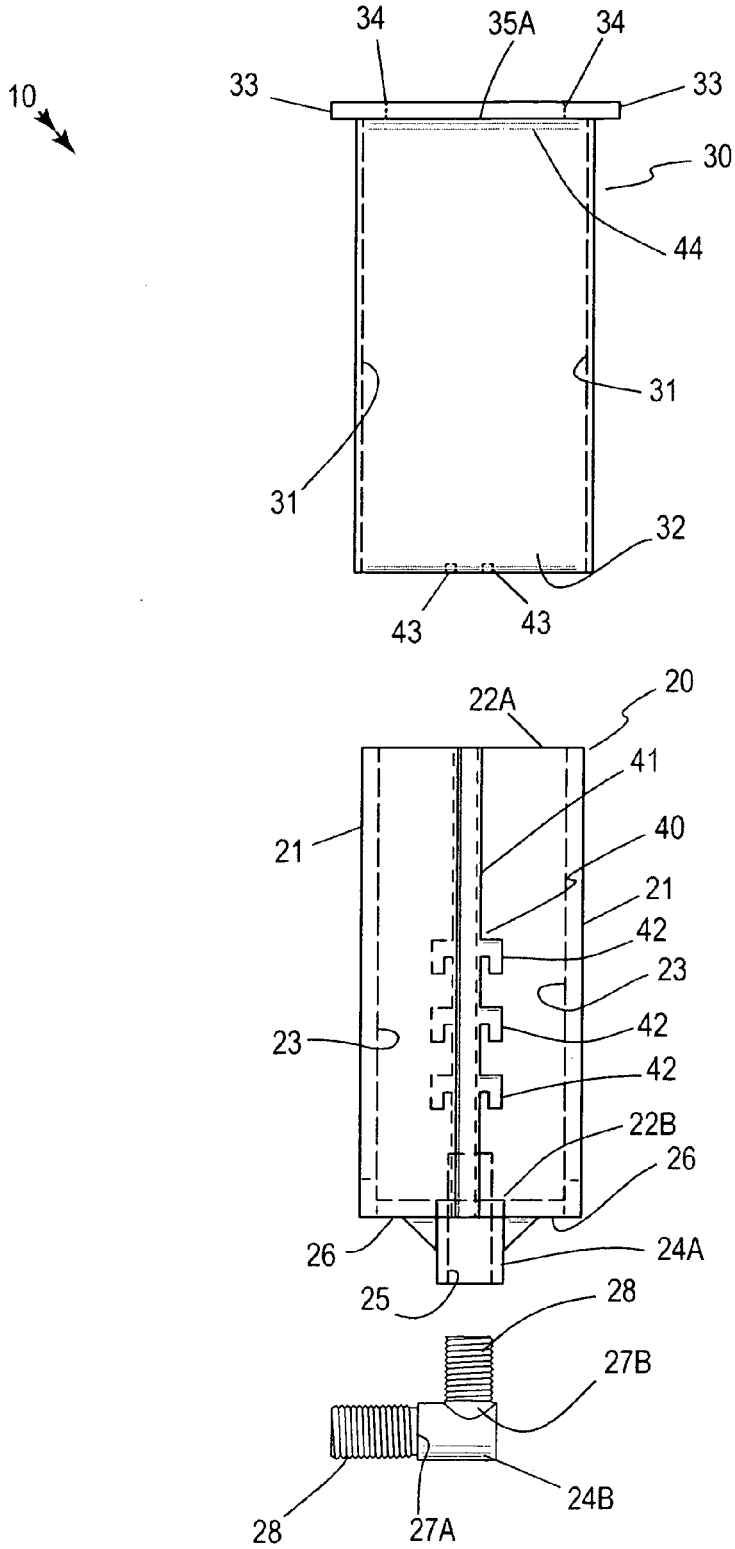
FIG. 3 is an exploded side-elevational view of the assembly shown in FIG. 2.
Figure 4:
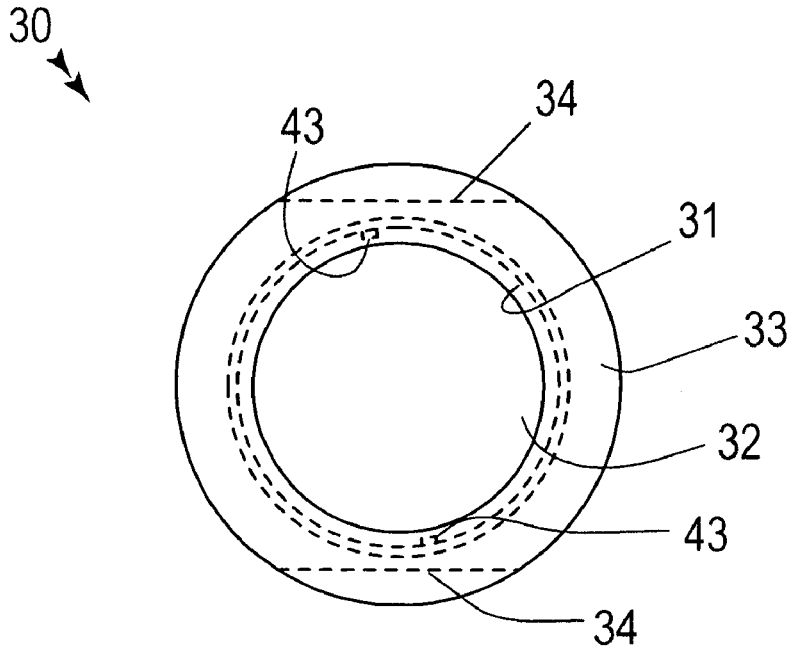
FIG. 4 is a top plan view of the outer casing shown in FIG. 3.

Referring to FIGS. 1, 2 and 3, a second coupling 24B has axially offset lower 27A and upper 27B end portions provided with a threaded outer surface 28. Such an upper end portion 27B is threadably and directly mated, without the use of intervening elements, with the first coupling 24A such that the lower end portion 27A becomes registered orthogonal to a vertical plane and protrudes outwardly from the inner casing 20. The lower end portion 27A is threadably mateable to an external water supply line (not shown), which is important for providing a free flowing source of water to the sprinkler head.

Referring to FIGS. 1 through 4, an outer casing 30 has a cylindrical shape and smooth inner surface 31 slidably and telescopically engageable directly, without the use of intervening elements, with the outer surface 21 of the inner casing 20. Such an outer casing 30 has a diameter greater than a diameter of the inner casing 20. The outer casing 30 has a centralized axial bore 32 formed therein such that the bore 32 becomes concentrically situated about the first coupling 24A when the outer casing 30 is position about the inner casing 20.

Again referring to FIGS. 1 through 4, such an outer casing 30 further has a top lip 33 monolithically formed therewith that radially protrudes outwardly from the inner surface 31. The top lip 33 is flanged outwardly and includes a pair of rectilinear creases 34 oppositely formed therein and extending tangential to a perimeter of the outer surface bore 32. Each crease 34 defines a line of weakness that is essential and advantageous for effectively allowing a user to snap off a portion of the top lip 33 when positioning the outer casing 30 adjacent to a flat surface like the wall of a building or a fence. Of course, the top lip 33 may be pre-formed to suitable shapes for this purpose and may also have additional creases 34 formed thereon for effectively fitting into corners, as is obvious to a person of ordinary skill in the art.

The top lip 33 also advantageously prevents vegetation from growing within the immediate vicinity of the sprinkler head, thus allowing the sprinkler to spray water therefrom in an unimpeded manner. The inner 20 and outer 30 casings are suitably sized and shaped for housing the in-ground sprinkler head (not shown) therein. Of course, the inner 20 and outer 30 casings may be formed in a variety of alternate shapes, sizes and diameters for receiving alternately shaped sprinkler heads, as is obvious to a person of ordinary skill in the art. Such inner 20 and outer 30 casings are formed from a polymer material and are outwardly spaced from the in-ground sprinkler head, which is a vital feature so that the in-ground sprinkler head can effectively freely rotate during operating conditions, as is its intended purpose.

Figure 5:
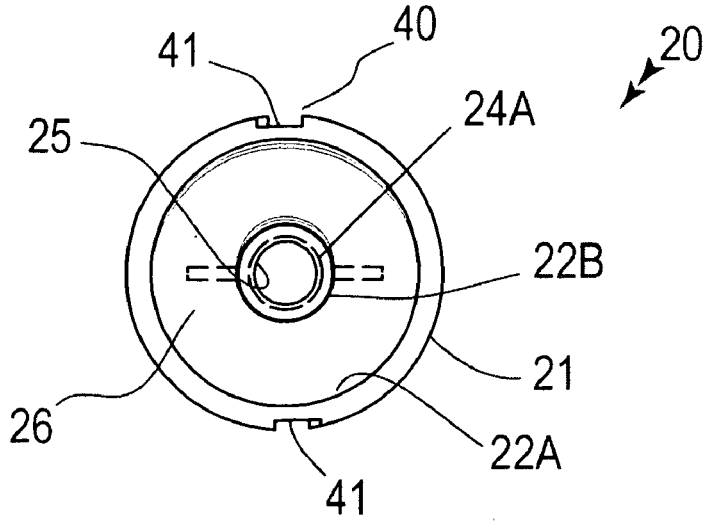
FIG. 5 is a top plan view of the inner casing shown in FIG. 3.

Referring to FIGS. 2, 3 and 5, a mechanism 40 is included for locking the inner 20 and outer 30 casings together such that the outer casing 30 is effectively prohibited from disengaging the lower casing 20 until at least one of the outer 30 and inner 20 casings is rotated approximately one quadrant along a rotational path so that the outer casing 30 can be vertically lifted away from the inner casing 20. The locking mechanism 40 includes an elongated and vertically oriented track 41 that has a longitudinal length equal to a longitudinal length of the inner casing 20. Such a track 41 has a plurality of vertically spaced L-shaped fingers 42 formed therein that are linearly displaced along the longitudinal axis of the inner casing 20.

Referring to FIGS. 2 and 3, a plurality of equidistantly spaced notches 43 are formed within the outer casing inner surface 31 for slidably and simultaneously receiving the L-shaped fingers 42 therein when the inner 20 and outer 30 casings are rotated about the longitudinal axis and vertically aligned. A plurality of grooves 44 are formed within a top edge 35A of the outer casing 30. Such grooves 44 are removably interlocked with selected ones of the L-shaped fingers 42 when the outer casing 30 is positioned over and down the inner casing outer surface 21.

Figure 6:
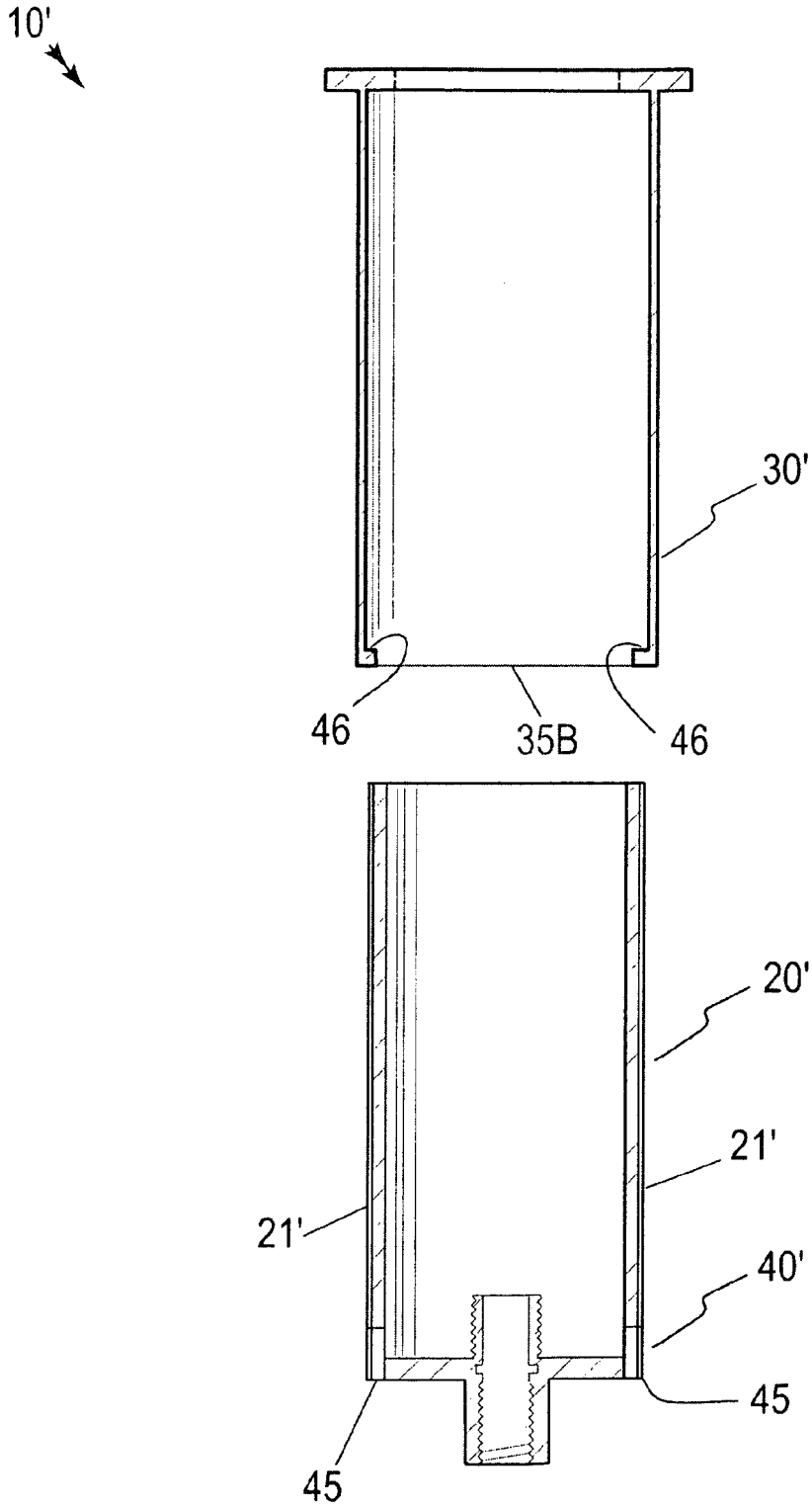
FIG. 6 is an exploded side-elevational view showing an alternate embodiment of the assembly shown in FIG. 1, in accordance with the present invention.

Referring to FIG. 6, in an alternate embodiment 10', the locking mechanism 40' includes a plurality of slots 45 formed within a bottom region of the inner casing 20'. An inwardly protruding flange 46 is monolithically formed at a bottom edge 35B of the outer casing 30'. Such a flange 46 is nested within the slots 45 when the outer casing 30' is positioned over and down the inner casing outer surface 21'.

Figure 7:
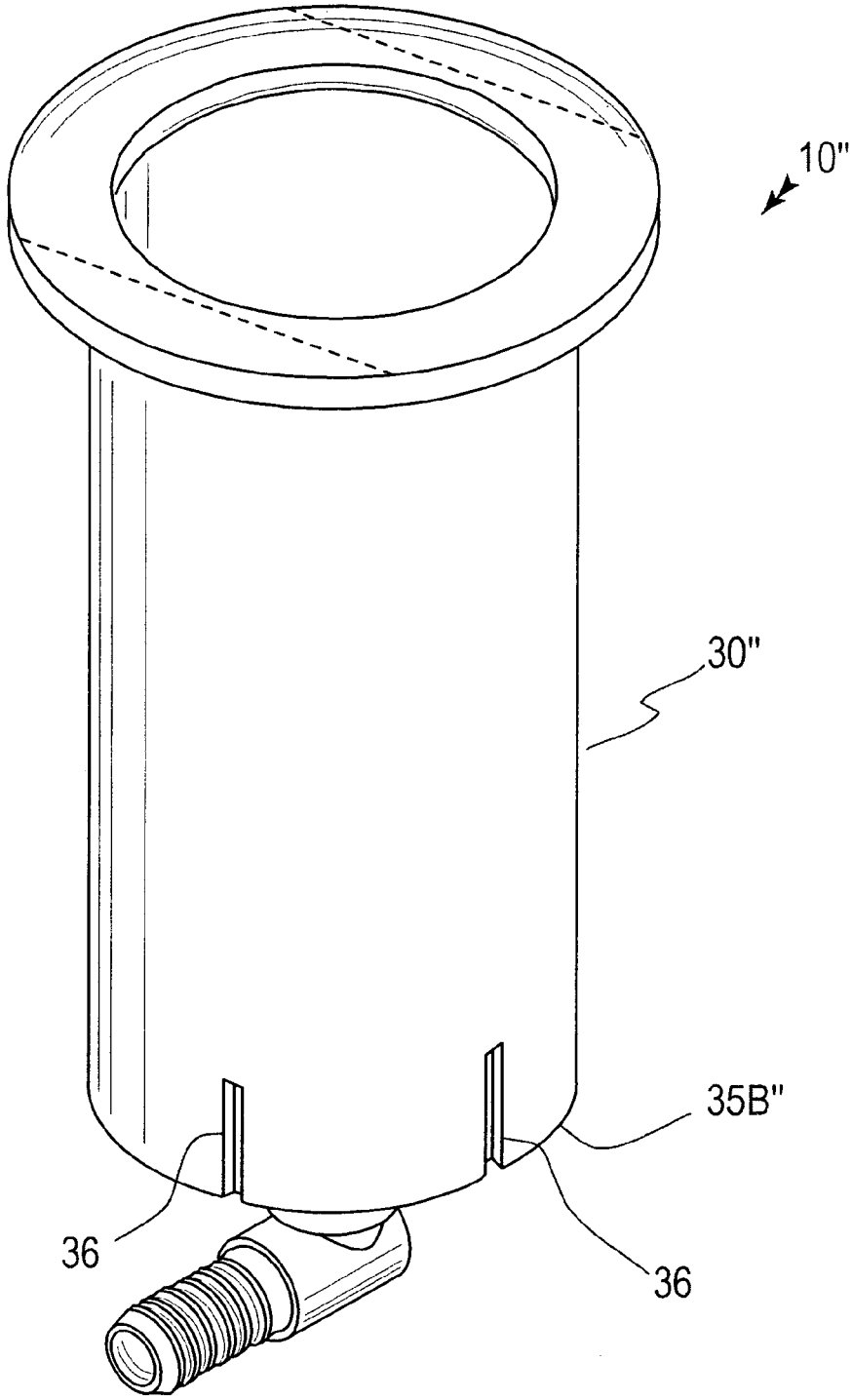
FIG. 7 is a perspective view showing another alternate embodiment of the assembly shown in FIG. 1, in accordance with the present invention.

Referring to FIG. 7, in another embodiment 10", the outer casing 30" includes a plurality of vertically oriented slots 36 formed therein that are equidistantly spaced apart about a periphery of the outer casing 30" respectively. Such slots 36 are contiguously situated adjacent to a bottom surface 35B" of the outer casing 30", which is a crucial feature such that undesirable debris and fluids can advantageously and effectively properly drain away from the outer casing 30 during inclement weather conditions.

Figure 8:
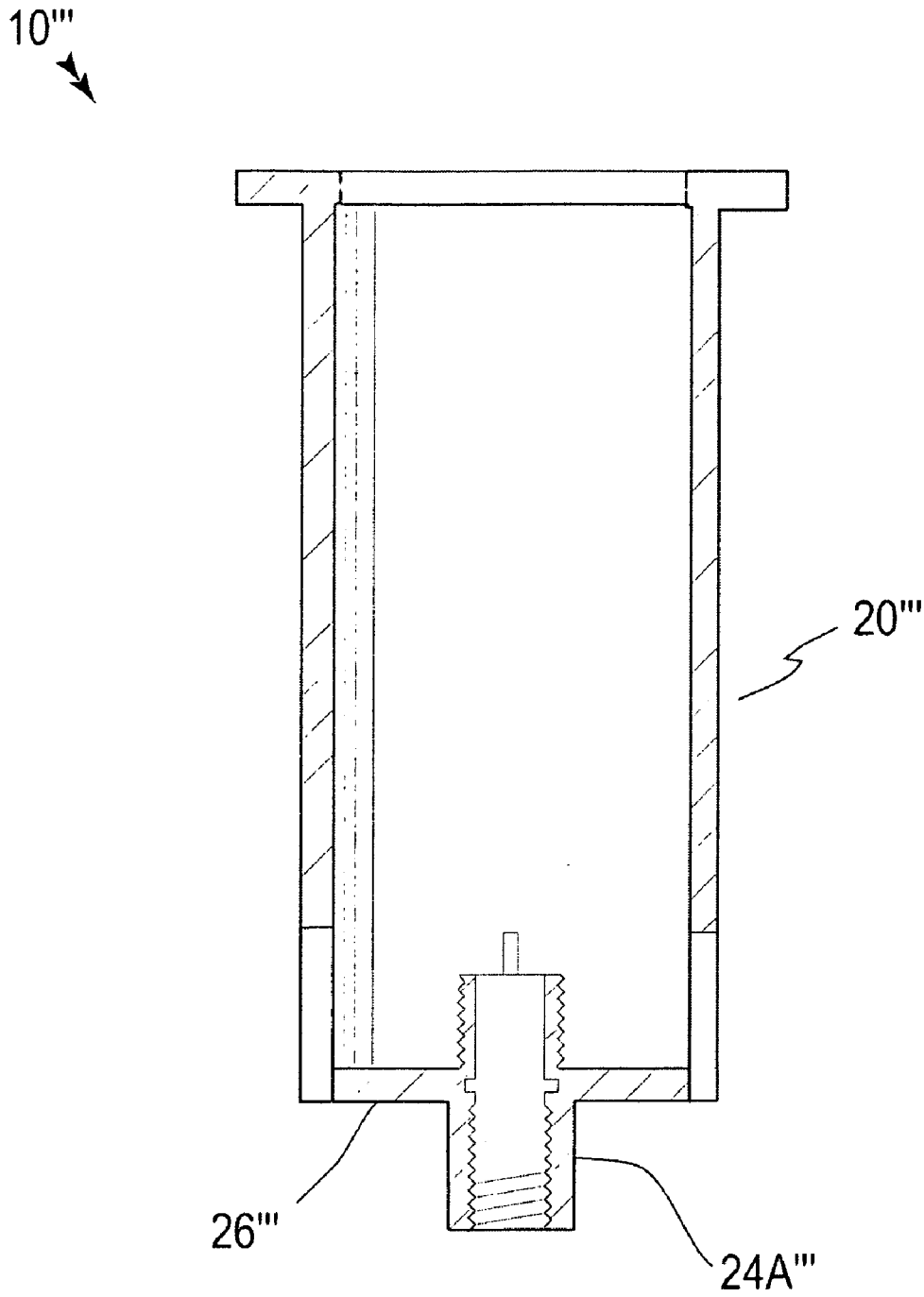
FIG. 8 is a cross-sectional view showing a further embodiment of the assembly shown in FIG. 1, in accordance with the present invention.

FIG. 8 shows a further embodiment 10''' wherein the casing 20''' is a single unitary body that has a fixed size and shape. The first coupling 24A''' is monolithically formed with a bottom surface 26''' of the casing 20'''.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An in-ground sprinkler head protective guard for preventing a lawn mower and the like from damaging an in-ground sprinkler head and for further preventing undesirable grass and weeds from growing along the in-ground sprinkler head and obstructing a discharge path of water flowing out from the in-ground sprinkler head, said in-ground sprinkler head protective guard comprising:

an inner casing having a hollow cylindrical shape and a smooth outer surface, said inner casing further having axially opposed and vertically aligned top and bottom openings in fluid communication with said inner surface;

a tubular and cylindrical first coupling directly conjoined to said inner casing and concentrically aligned within said bottom opening, said coupling having a threaded inner surface extending downwardly from said inner casing and terminating at a predetermined location subjacent to a bottom surface of said inner casing;

a second coupling having axially offset lower and upper end portions provided with a threaded outer surface, said upper end portion being threadably and directly mated with said first coupling such that said lower end portion becomes registered orthogonal to a vertical plane and protrudes outwardly from said inner casing, said lower end portion being threadably mateable to an external water supply line;

an outer casing having a cylindrical shape and smooth inner surface slidably and telescopically engageable directly with said outer surface of said inner casing, said outer casing having a centralized axial bore formed therein such that said bore becomes concentrically situated about said first coupling when said outer casing is positioned about said inner casing, said outer casing further having a top lip monolithically formed therewith and radially protruding outwardly from said inner surface, said top lip being flanged outwardly and including a pair of rectilinear creases oppositely formed therein and extending tangential to a perimeter of said outer casing bore, each of said creases defining a line of weakness for allowing a user to snap off a portion of said top lip when positioning said outer casing adjacent to a flat surface; and means for locking said inner and outer casings together such that said outer casing is prohibited from disengaging said inner casing until at least one of said outer and inner casing is rotated approximately one quadrant along a rotational path so that said outer casing can be vertically lifted away from said inner casing.

2. The apparatus of claim 1, wherein said locking means comprises:

an elongated and vertically oriented track having a longitudinal length equal to a longitudinal length of said inner casing, said track having a plurality of vertically spaced L-shaped fingers formed therein and linearly displaced along the longitudinal axis of said inner casing;

a plurality of equidistantly spaced notches formed within said outer casing inner surface for slidably and simultaneously receiving said L-shaped fingers therein when said inner and outer casings are rotated about the longitudinal axis and vertically aligned; and a plurality of grooves formed within a top edge of said outer casing, said grooves being removably interlocked with selected ones of said L-shaped fingers when said outer casing is positioned over and down said inner casing outer surface.

3. The apparatus of claim 1, wherein said locking means comprising:

a plurality of slots formed within a bottom region of said inner casing;

an inwardly protruding flange monolithically formed at a bottom edge of said outer casing;

wherein said flange is nested within said slots when said outer casing is positioned over and down said inner casing outer surface.

4. The apparatus of claim 1, wherein said outer casing includes a plurality of vertically oriented slots formed therein and equidistantly spaced apart about a periphery of said outer casing respectively, said slots being contiguously situated adjacent a bottom surface of said outer casing such that undesirable debris and fluids can properly drain away from said outer casing during inclement weather conditions.

5. The apparatus of claim 1, wherein said outer casing has a diameter greater than a diameter of said inner casing.

6. An in-ground sprinkler head protective guard for preventing a lawn mower and the like from damaging an in-ground sprinkler head and for further preventing undesirable grass and weeds from growing along the in-ground sprinkler head and obstructing a discharge path of water flowing out from the in-ground sprinkler head, said in-ground sprinkler head protective guard comprising:

an inner casing having a hollow cylindrical shape and a smooth outer surface, said inner casing further having axially opposed and vertically aligned top and bottom openings in fluid communication with said inner surface;

a tubular and cylindrical first coupling directly conjoined to said inner casing and concentrically aligned within said bottom opening, said coupling having a threaded inner surface extending downwardly from said inner casing and terminating at a predetermined location subjacent to a bottom surface of said inner casing;

a second coupling having axially offset lower and upper end portions provided with a threaded outer surface, said upper end portion being threadably and directly mated with said first coupling such that said lower end portion becomes registered orthogonal to a vertical plane and protrudes outwardly from said inner casing, said lower end portion being threadably mateable to an external water supply line;

an outer casing having a cylindrical shape and smooth inner surface slidably and telescopically engageable directly with said outer surface of said inner casing, said outer casing having a centralized axial bore formed therein such that said bore becomes concentrically situated about said first coupling when said outer casing is positioned about said inner casing, said outer casing further having a top lip monolithically formed therewith and radially protruding outwardly from said inner surface, said top lip being flanged outwardly and including a pair of rectilinear creases oppositely formed therein and extending tangential to a perimeter of said outer casing bore, each of said creases defining a line of weakness for allowing a user to snap off a portion of said top lip when positioning said outer casing adjacent to a flat surface, each of said inner and outer casings being suitably sized and shaped for housing the in-ground sprinkler head therein; and means for locking said inner and outer casings together such that said outer casing is prohibited from disengaging said inner casing until at least one of said outer and inner casing is rotated approximately one quadrant along a rotational path so that said outer casing can be vertically lifted away from said inner casing.

7. The apparatus of claim 6, wherein said locking means comprises:

an elongated and vertically oriented track having a longitudinal length equal to a longitudinal length of said inner casing, said track having a plurality of vertically spaced L-shaped fingers formed therein and linearly displaced along the longitudinal axis of said inner casing;

a plurality of equidistantly spaced notches formed within said outer casing inner surface for slidably and simultaneously receiving said L-shaped fingers therein when said inner and outer casings are rotated about the longitudinal axis and vertically aligned; and a plurality of grooves formed within a top edge of said outer casing, said grooves being removably interlocked with selected ones of said L-shaped fingers when said outer casing is positioned over and down said inner casing outer surface.

8. The apparatus of claim 6, wherein said locking means comprising:

a plurality of slots formed within a bottom region of said inner casing;

an inwardly protruding flange monolithically formed at a bottom edge of said outer casing;

wherein said flange is nested within said slots when said outer casing is positioned over and down said inner casing outer surface.

9. The apparatus of claim 6, wherein said outer casing includes a plurality of vertically oriented slots formed therein and equidistantly spaced apart about a periphery of said outer casing respectively, said slots being contiguously situated adjacent a bottom surface of said outer casing such that undesirable debris and fluids can properly drain away from said outer casing during inclement weather conditions.

10. The apparatus of claim 6, wherein said outer casing has a diameter greater than a diameter of said inner casing.

11. An in-ground sprinkler head protective guard for preventing a lawn mower and the like from damaging an in-ground sprinkler head and for further preventing undesirable grass and weeds from growing along the in-ground sprinkler head and obstructing a discharge path of water flowing out from the in-ground sprinkler head, said in-ground sprinkler head protective guard comprising:

an inner casing having a hollow cylindrical shape and a smooth outer surface, said inner casing further having axially opposed and vertically aligned top and bottom openings in fluid communication with said inner surface;

a tubular and cylindrical first coupling directly conjoined to said inner casing and concentrically aligned within said bottom opening, said coupling having a threaded inner surface extending downwardly from said inner casing and terminating at a predetermined location subjacent to a bottom surface of said inner casing;

a second coupling having axially offset lower and upper end portions provided with a threaded outer surface, said upper end portion being threadably and directly mated with said first coupling such that said lower end portion becomes registered orthogonal to a vertical plane and protrudes outwardly from said inner casing, said lower end portion being threadably mateable to an external water supply line;

an outer casing having a cylindrical shape and smooth inner surface slidably and telescopically engageable directly with said outer surface of said inner casing, said outer casing having a centralized axial bore formed therein such that said bore becomes concentrically situated about said first coupling when said outer casing is positioned about said inner casing, said outer casing further having a top lip monolithically formed therewith and radially protruding outwardly from said inner surface, said top lip being flanged outwardly and including a pair of rectilinear creases oppositely formed therein and extending tangential to a perimeter of said outer casing bore, each of said creases defining a line of weakness for allowing a user to snap off a portion of said top lip when positioning said outer casing adjacent to a flat surface, each of said inner and outer casings being suitably sized and shaped for housing the in-ground sprinkler head therein, each of said inner and outer casings being formed from a polymer material and outwardly spaced from the in-ground sprinkler head so that the in-ground sprinkler head can freely rotate during operating conditions; and means for locking said inner and outer casings together such that said outer casing is prohibited from disengaging said inner casing until at least one of said outer and inner casing is rotated approximately one quadrant along a rotational path so that said outer casing can be vertically lifted away from said inner casing.

12. The apparatus of claim 11, wherein said locking means comprises:

an elongated and vertically oriented track having a longitudinal length equal to a longitudinal length of said inner casing, said track having a plurality of vertically spaced L-shaped fingers formed therein and linearly displaced along the longitudinal axis of said inner casing;

a plurality of equidistantly spaced notches formed within said outer casing inner surface for slidably and simultaneously receiving said L-shaped fingers therein when said inner and outer casings are rotated about the longitudinal axis and vertically aligned; and a plurality of grooves formed within a top edge of said outer casing, said grooves being removably interlocked with selected ones of said L-shaped fingers when said outer casing is positioned over and down said inner casing outer surface.

13. The apparatus of claim 11, wherein said locking means comprising:

a plurality of slots formed within a bottom region of said inner casing;

an inwardly protruding flange monolithically formed at a bottom edge of said outer casing;

wherein said flange is nested within said slots when said outer casing is positioned over and down said inner casing outer surface.

14. The apparatus of claim 11, wherein said outer casing includes a plurality of vertically oriented slots formed therein and equidistantly spaced apart about a periphery of said outer casing respectively, said slots being contiguously situated adjacent a bottom surface of said outer casing such that undesirable debris and fluids can properly drain away from said outer casing during inclement weather conditions.

15. The apparatus of claim 11, wherein said outer casing has a diameter greater than a diameter of said inner casing.

* * * * *